US008044761B2

(12) United States Patent
Yanagida et al.

(10) Patent No.: US 8,044,761 B2
(45) Date of Patent: Oct. 25, 2011

(54) VARISTOR

(75) Inventors: Miyuki Yanagida, Tokyo (JP); Koichi Yamaguchi, Tokyo (JP); Katsuhiko Igarashi, Tokyo (JP); Naoki Chida, Tokyo (JP)

(73) Assignee: TDK Corporation, Tokyo (JP)

( * ) Notice: Subject to any disclaimer, the term of this patent is extended or adjusted under 35 U.S.C. 154(b) by 496 days.

(21) Appl. No.: 12/337,081

(22) Filed: Dec. 17, 2008

(65) Prior Publication Data

US 2009/0160600 A1 Jun. 25, 2009

(30) Foreign Application Priority Data

Dec. 20, 2007 (JP) ..... P2007-329092

(51) Int. Cl.
*H01C 7/10* (2006.01)

(52) U.S. Cl. ..... 338/21; 338/309; 252/519.51

(58) Field of Classification Search ..... 338/20–21, 338/22 R, 309; 252/519.5, 519.51
See application file for complete search history.

(56) References Cited

U.S. PATENT DOCUMENTS

| | | | | |
|---|---|---|---|---|
| 4,160,748 | A | 7/1979 | Yodogawa et al. | |
| 4,473,812 | A * | 9/1984 | Maruyama et al. | 338/21 |
| 4,477,793 | A * | 10/1984 | Mukae et al. | 338/21 |
| 5,764,129 | A | 6/1998 | Syouji et al. | |
| 5,994,995 | A * | 11/1999 | Ogasawara et al. | 338/21 |
| 2005/0205127 | A1 | 9/2005 | Watanabe et al. | |
| 2007/0117237 | A1 | 5/2007 | Inoue | |

FOREIGN PATENT DOCUMENTS

| | | |
|---|---|---|
| CN | 100477288 | 4/2009 |
| CN | 100585752 | 1/2010 |
| EP | 0 617 436 | 9/1994 |
| JP | 6-45109 | 2/1994 |
| JP | 3097332 | 8/2000 |
| JP | 2002-246207 | 8/2002 |
| JP | 3493384 | 11/2003 |

* cited by examiner

*Primary Examiner* — Kyung Lee
(74) *Attorney, Agent, or Firm* — Drinker Biddle & Reath LLP

(57) ABSTRACT

A varistor 1 comprises a varistor element 10, a pair of external electrodes 30*a*, 30*b* on one main side of the varistor element 10 and a resistor 60 on the same main side, wherein the resistor 60 is formed so as to connect the pair of external electrodes 30*a*, 30*b*. The varistor element 10 contains zinc oxide as the main component and Ca oxides, Si oxides and rare earth metal oxides as accessory components, wherein the proportion X of the calcium oxides in terms of calcium atoms is 2-80 atomic percent with respect to 100 mol of the main component and the proportion Y of the silicon oxides in terms of silicon atoms is 1-40 atomic percent with respect to 100 mol of the main component, X/Y satisfying formula (1) below, and the external electrodes and resistor contain oxides other than bismuth oxide and copper oxide $$1 \leq X/Y < 3 \quad (1).$$

6 Claims, 10 Drawing Sheets

VARISTOR

BACKGROUND OF THE INVENTION

1. Field of the Invention

The present invention relates to a varistor integrally comprising a resistor and a varistor element.

2. Related Background Art

Varistors are used in, for example, controlling devices, communication devices and their parts, to absorb or eliminate external surges (abnormal voltage) such as static electricity or noise, for protection against such external surges or noise.

The use of zinc oxide as a major component and rare earth elements, calcium oxide and silicon oxide as accessory components has been proposed for the constituent components of varistor elements in varistors, in order to enhance the varistor characteristics such as voltage non-linearity, as well as the discharge withstand current rating (see Japanese Patent Publication No. 3493384, for example).

Serial connection of resistors in a varistor requires separate mounting of two elements on the printed board, and thus increases the mounting space and conflicts against high-density mounting. Varistors that integrate varistor elements and resistors have been proposed as means for realizing high-density mounting (see Japanese Patent Publication No. 3097332, for example).

SUMMARY OF THE INVENTION

Varistors integrally comprising varistor elements and resistors for high-density mounting are preferably varistors with low electrostatic capacity so that they can exhibit satisfactory varistor characteristics and minimal effects on signals even with high-speed digital signals and transmission speeds.

It has been found that the varistor characteristics are impaired when a varistor integrally comprising a varistor element and resistor is fabricated. Upon examining the cause of this, it was discovered that the reduction in varistor characteristics is due to reaction products produced by reaction between the components of the varistor element, the conductors formed on the varistor element, and the resistor.

The present invention has been accomplished in light of these circumstances, and its object is to provide a varistor capable of high-density mounting and exhibiting excellent varistor characteristics while having sufficiently reduced resistance fluctuation.

In order to achieve this object, the invention provides a varistor comprising a varistor element, a pair of external electrodes on one main side of the varistor element and a resistor on the same main side, the resistor being formed in connection with the pair of external electrodes, wherein the varistor element has a main component and accessory components, containing zinc oxide as the main component and calcium oxides, silicon oxides and rare earth metal oxides as the accessory components, the proportion X of the calcium oxides in terms of calcium atoms is 2-80 atomic percent with respect to 100 mol of the main component and the proportion Y of the silicon oxides in terms of silicon atoms is 1-40 atomic percent with respect to 100 mol of the main component, the ratio of X to Y (X/Y) satisfies the following formula (1), and the external electrode and resistor contain oxides other than bismuth oxide and copper oxide.

$$1 \leqq X/Y < 3 \quad (1)$$

The varistor of the invention exhibits excellent varistor characteristics while adequately reducing fluctuations in resistance. The reason for this effect is conjectured by the present inventors to be as follows. Specifically, since the varistor element provided in the varistor of the invention comprises a resistor and an external electrode containing oxides different from bismuth oxide and copper oxide, it is possible to adequately prevent reaction between the external electrodes, varistor element and resistor during production and use of the varistor. This can minimize reaction products in the external electrode, varistor element and resistor. For this reason, it is conjectured, it is possible to maintain the original excellent varistor characteristics of the varistor element without any impairment, and adequately reduce fluctuation in the resistance value.

According to the invention, a base glass layer is preferably provided between the main side of the varistor element and either or both the pair of external electrodes and the resistor.

A varistor provided with a base glass layer between the varistor element and either or both the pair of external electrodes and the resistor has sufficiently reduced reaction between the external electrodes and varistor element, as well as sufficiently minimized reaction with either or both the resistor and the varistor element.

The resistor in the varistor of the invention is preferably provided so as to cover at least part of the sides of the external electrodes opposite their varistor element sides.

Using a resistor of this type can further improve the bonding strength between the resistor and the conductors. It is thus possible to further prevent fluctuations in the resistance value of the varistor while also improving the durability and reliability.

The varistor of the invention is preferably provided with a glass layer covering the resistor and the pair of external electrodes. Such a glass layer will also provide protection to the varistor. It can also further improve the durability and reliability of the varistor.

According to the invention it is possible to provide a varistor capable of high-density mounting and exhibiting excellent varistor characteristics while having sufficiently reduced resistance fluctuation.

DESCRIPTION OF THE PREFERRED EMBODIMENTS

Preferred embodiments of the invention will now be explained with reference to the accompanying drawings where necessary.

First Embodiment

Figure 1:
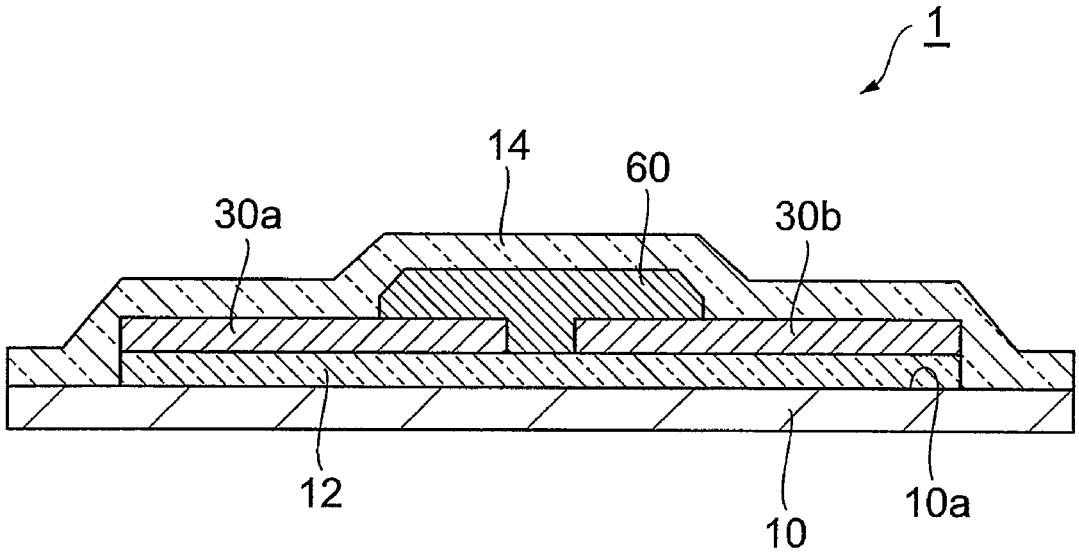
FIG. 1 is a schematic cross-sectional view of a varistor according to a first embodiment of the invention.

FIG. 1 is a schematic cross-sectional view of a varistor according to a first embodiment of the invention. In the varistor 1, a base glass layer 12 is laminated in contact with one main side 10*a* of a varistor element 10. A pair of external electrodes 30*a*, 30*b* is provided in contact with the main side of the base glass layer 12 opposite the varistor element 10 side. A resistor 60 is also provided in contact with the main side. That is, the pair of external electrodes 30*a*, 30*b* and the resistor 60 are both formed on the same main side of the base glass layer 12. The resistor 60 is formed provided in such a manner as to connect the pair of external electrodes 30*a*, 30*b*. At least part of the resistor 60 is formed between the pair of external electrodes 30*a*, 30*b*. The resistor 60 is also formed so as to cover portions of the sides of the pair of external electrodes 30*a*, 30*b* opposite the base glass layer 12 sides (the resistor 60 sides). The varistor 1 has a protective layer (overglaze) 14 on the outermost layer. The protective layer 14 is formed so as to cover the varistor element 10, external electrodes 30*a*, 30*b* and resistor 60.

As shown in FIG. 1, the thickness of each of the external electrodes 30*a*, 30*b* is preferably such that the thickness at the section covering the resistor 60 is greater than the thickness at the other sections. This will help improve the bonding strength between the external electrodes 30*a*, 30*b* and resistor 60.

The varistor element 10 contains zinc oxide (ZnO) as the main component, as well as a rare earth metal oxide, calcium oxide and silicon oxide as accessory components. The ZnO content with respect to the entire varistor element 10 is preferably 70-99 atomic percent from the viewpoint of obtaining excellent varistor characteristics. This will allow high level properties to be achieved, including high varistor characteristics and large surge resistance.

The rare earth metal oxide included as an accessory component in the varistor element 10 is preferably at least one type of oxide selected from the group consisting of Y, La, Ce, Pr, Nd, Sm, Eu, Gd, Tb, Dy, Ho, Er, Tm, Yb and Lu. The rare earth metal oxide content is preferably 0.01-10 atomic percent in terms of rare earth metal with respect to zinc oxide as the main component. Voltage non-linearity will not be easily exhibited if the rare earth metal element oxide content is too low, while the varistor voltage will tend to increase drastically if the content is too high. The rare earth oxide is more preferably an oxide of Pr.

The calcium oxide content of the varistor element 10 is 2-80 atomic percent in terms of calcium atoms with respect to zinc oxide. The silicon oxide content of the varistor element 10 is 1-40 atomic percent in terms of silicon atoms with respect to zinc oxide. The proportion of calcium oxide with respect to silicon oxide is the atomic ratio of calcium atoms to silicon atoms (Ca/Si), and it satisfies general formula (1) above.

The electrostatic capacity of the varistor is generally represented by:

$$C=\in_0\in_r(S/d). \tag{2}$$

In this formula, C represents the electrostatic capacity, $\in_0$ represents the permittivity in a vacuum, $\in_r$ represents the relative permittivity, S represents the area of the opposite electrodes, by which electrostatic capacity is exhibited, and d represents the thickness between the opposite electrodes. Care is necessary when dealing with the thickness d of a varistor containing zinc oxide as the main component, i.e. a zinc oxide-based varistor. A zinc oxide-based varistor exhibits its characteristics by its grain boundaries. That is, under steady state conditions a significant difference exists between the resistance at the grain boundaries and the resistance inside the grains, with the resistance at the grain boundaries being much greater than inside the grains. Thus, under steady state conditions not exceeding the breakdown voltage (build-up voltage), almost the entire applied electric field impacts the grain boundaries. The thickness d must therefore take this factor into account.

The thickness d is represented by:

$$d=n\cdot 2W. \tag{3}$$

Here, n is the number of grain boundaries parallel to the opposite electrodes, and 2 W is the depletion layer width of a single grain boundary.

The relationship between the varistor voltage $V_{1mA}$ and the number of grain boundaries n is as follows:

$$n=V_{1mA}/\phi. \tag{4}$$

Here, $\phi$ is the barrier height at the grain boundary, which is the value representing the varistor voltage per grain boundary.

Substituting formula (3) and formula (4) into formula (2) gives the following formula:

$$C\cdot V_{1mA}=\in_0\in_r\cdot(\phi\cdot S/2W). \tag{5}$$

Assuming optimal voltage non-linearity, $\phi$ and 2 W are constant values (for example, $\phi$=0.8 eV, 2 W=30 nm), and therefore formula (5) is constant so long as the area S of the opposite electrodes is constant. Stated differently, the electrostatic capacity can be lowered while maintaining optimal voltage non-linearity by reducing the area S of the opposite electrodes.

The method for reducing the area S of the opposite electrodes may be direct reduction in the area of the opposite electrodes. However, if the area of the opposite electrodes is simply reduced, the maximum tolerated energy and maximum tolerated surge will be lower as a result, thus tending to lower the voltage non-linearity or the reliability of the element. It is therefore desirable to control the microstructure of the ceramic in order to minimize reduction in the maximum tolerated energy and maximum tolerated surge and reduce the electrostatic capacity. In other words, by providing a first phase composed mainly of zinc oxide and a second phase composed of an oxide other than zinc oxide, and controlling the volume fraction of the second phase, the area of the grain boundaries of zinc oxide that exhibit electrostatic capacity between the opposite electrodes is reduced. This can lower the electrostatic capacity without reducing the area of the opposite electrodes.

A varistor element in a varistor according to the invention contains calcium oxides and silicon oxides, as mentioned above. Consequently, the crystal structure of the varistor element has a second phase composed of complex oxides synthesized by reaction of Ca and Si (for example, $CaSiO_3$ or $Ca_2SiO_4$) introduced into a first phase composed mainly of zinc oxide, and the volume fraction of the second phase is controlled to the desired value. The area of the zinc oxide grain boundaries is therefore low. Complex oxides of Ca and Si have lower permittivity than zinc oxide and do not inhibit the voltage non-linearity. The electrostatic capacity of the varistor element can be reduced as a result.

As calcium oxides to be included in the varistor element there may be mentioned CaO, and complex oxides containing calcium, silicon and oxygen, such as $CaSiO_3$ or $Ca_2SiO_4$. As silicon oxides to be included in the varistor element there may be mentioned $SiO_2$, and complex oxides containing calcium, silicon and oxygen such as $CaSiO_3$ or $Ca_2SiO_4$, or $Zn_2SiO_4$.

The varistor element of this embodiment preferably contains at least one oxide selected from among Co oxides and Group IIIB elements, in addition to the accessory components mentioned above. As Group IIIB elements there are preferred B, Al, Ga or In.

The Co oxide content is preferably 0.05-10 atomic percent in terms of Co with respect to zinc oxide as the main component. If the content is less than 0.05 atomic percent it will tend to be difficult to obtain the desired varistor voltage, while if the content exceeds 10 atomic percent, the varistor voltage will tend to increase and the voltage non-linearity will tend to be reduced.

The content of one or more oxides selected from among Group IIIB elements is preferably 0.0005-0.5 atomic percent in terms of the selected Group IIIB element with respect to zinc oxide as the main component. If the content is less than 0.0005 atomic percent the varistor voltage will tend to increase, while if the content exceeds 0.5 atomic percent, the resistance will tend to be lower and it may not be possible to obtain the intended varistor voltage.

The varistor element of this embodiment also preferably contains at least one oxide selected from among Group IA elements, as another accessory component. As Group IA elements there are preferred Na, K, Rb or Cs.

The content of one or more oxides selected from among Group IA elements is preferably less than 5 atomic percent in terms of the selected Group IA element with respect to zinc oxide as the main component. If the content is 5 atomic percent or greater, the melting point of the ceramic will be lowered and it will tend to melt during firing.

The varistor element of this embodiment also preferably contains at least one oxide selected from among Group IIA elements other than Ca, as another accessory component. As Group IIA elements there are preferred Mg, Sr or Ba.

The content of one or more oxides selected from among Group IIA elements other than Ca is preferably less than 1 atomic percent in terms of the selected Group IIA element with respect to zinc oxide as the main component. If the content is 1 atomic percent or greater, the varistor voltage will tend to be increased.

The varistor element of this embodiment also preferably contains at least one oxide selected from among Cr and Mo, as another accessory component. The content of this oxide is preferably less than 10 atomic percent in terms of Cr atoms and Mo atoms each with respect to zinc oxide as the main component. If the content is greater than 10 atomic percent, the varistor voltage will tend to be increased.

The external electrodes 30*a*, 30*b* are conductors, and they contain oxides different from bismuth oxide and copper oxide (CuO). Examples of such oxides include $SiO_2$, NiO, MnO and $Al_2O_3$. The external electrodes 30*a*, 30*b* preferably contain simple metals in addition to the aforementioned oxides. Such simple metals are preferably Ag, Pd, Pt and the like.

The total content of oxides in each of the external electrodes 30*a*, 30*b* is preferably 0.01-20 wt % with respect to the total external electrode. If the total content of oxides is less than 0.01 wt % the bonding strength for the base material will tend to be low, and if it exceeds 20 wt % the electrical conductivity will tend to be impaired. The thickness of each external electrode 30*a*, 30*b* may be 1-30 μm, for example.

The resistor 60 may contain a conductive oxide such as $RuO_2$, $SnO_2$ or $LaB_6$, an oxide such as $Al_2O_3$, $B_2O_3$ or $SiO_2$, and a simple metal such as Pd, Ag or Pt.

The resistor 60 contains an oxide different from bismuth oxide and copper oxide (CuO). The oxide content of the resistor 60 is preferably 50-99 wt %. This will help to further prevent fluctuations in the resistance value. The thickness of the resistor 60 may be 1-30 μm, for example.

The base glass layer 12 contains an oxide commonly included in glass, such as $HfO_2$, CaO, $Al_2O_3$, $SiO_2$, ZnO, BaO or $B_2O_3$. The content of bismuth oxide and copper oxide (CuO) in the base glass layer 12 is preferably no greater than 1 wt % and more preferably no greater than 0.5 wt % each, with respect to the total base glass layer 12. The base glass layer 12 preferably also contains an oxide different from bismuth oxide and copper oxide. By reducing the content of bismuth oxide and copper oxide in the base glass layer 12, it is possible to further prevent reaction between the varistor element 10 and the external electrodes 30*a*, 30*b* and resistor 60. This can help further minimize reaction products in the varistor element 10, external electrodes 30*a*, 30*b* and resistor 60. The thickness of the base glass layer 12 may be 1-30 μm, for example.

The protective layer 60 is formed in order to protect the varistor element 10, external electrodes 30*a*, 30*b* and resistor 60. The protective layer 60 contains a glass or ceramic as the main component. The thickness of the protective layer may be 1-30 μm, for example.

As mentioned above, the external electrodes 30*a*, 30*b* of the varistor 1 according to this embodiment contain oxides other than bismuth oxide and copper oxide. It is thus possible to prevent reaction between the varistor 1 and external electrodes 30*a*, 30*b*, and between the external electrodes 30*a*, 30*b* and resistor 60. When the external electrodes contain bismuth oxide or copper oxide, the bismuth oxide or copper oxide reacts with the varistor element 10 components to form reaction products. Because bismuth can form a trivalent cation, a semiconductor may be formed as a reaction product. This can potentially lower the varistor characteristics.

Figure 2:
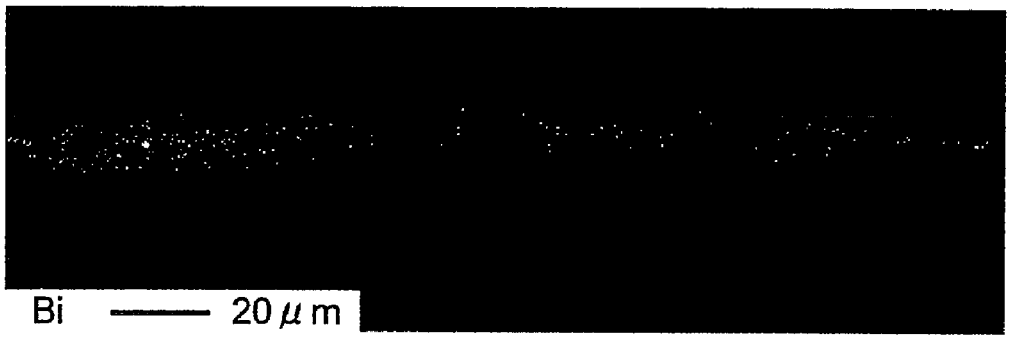
FIG. 2 shows elemental distribution in a cross-section of the varistor 1 of the first embodiment, based on analysis with an Electron probe microanalyzer (EPMA).

FIG. 2 shows elemental distribution in a cross-section of the varistor 1 of the first embodiment, based on analysis with an Electron probe microanalyzer (EPMA). FIG. 2 shows the distribution of bismuth (Bi) in the laminated structure obtained by laminating the external electrodes, base glass layer and varistor element in that order from the top.

According to FIG. 2, the varistor 1 of this embodiment does not contain bismuth oxide in the external electrodes, and therefore no bismuth is detected in the varistor element (FIG. 2, bottom). That is, no bismuth component is diffused in the varistor element, and no bismuth compounds are present. Consequently, the varistor 1 of this embodiment that comprises this type of varistor element exhibits excellent varistor characteristics. Furthermore, since the resistor and external electrodes also contain no reaction products, fluctuations in the resistance value can also be satisfactorily reduced.

Figure 3:
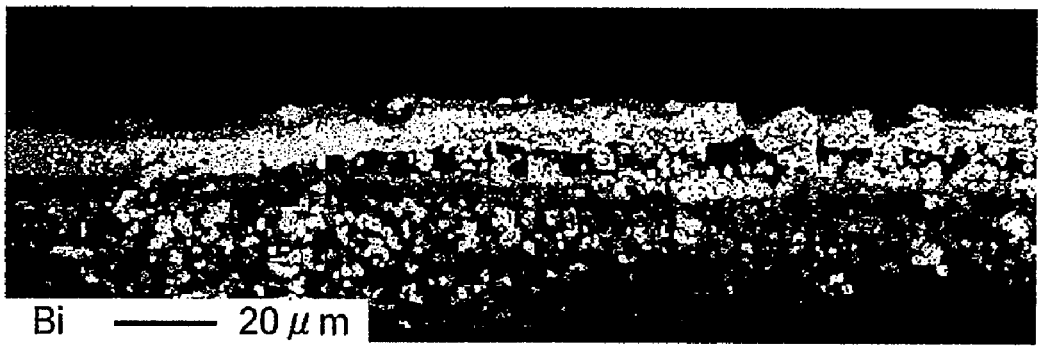
FIG. 3 shows elemental distribution in a cross-section of a conventional varistor, based on analysis with an Electron probe microanalyzer (EPMA).

FIG. 3 shows elemental distribution in a cross-section of a conventional varistor, based on analysis with an Electron probe microanalyzer (EPMA). FIG. 3 shows the distribution of bismuth (Bi) in the laminated structure obtained by laminating the external electrodes, base glass layer and varistor element in that order from the top.

In the varistor of FIG. 3 that employs external electrodes containing bismuth oxide, bismuth is detected in the external electrodes (FIG. 3, middle). A varistor element provided with this type of varistor is formed using the same starting materials as the varistor element shown in FIG. 2, and should contain no bismuth component. However, this varistor element contains reaction products (bismuth-containing compounds) due to reaction between the external electrodes and the varistor element during production of the varistor.

(See FIG. 3 below.) A varistor comprising such a varistor element does not exhibit sufficient varistor characteristics. Furthermore, since the resistor and external electrodes also contain no reaction products, fluctuations in the resistance value are significantly large.

Second Embodiment

A varistor according to a second embodiment of the invention will now be explained with reference to FIGS. 4 to 8. The varistor of this embodiment is a stacked chip varistor.

Figure 4:
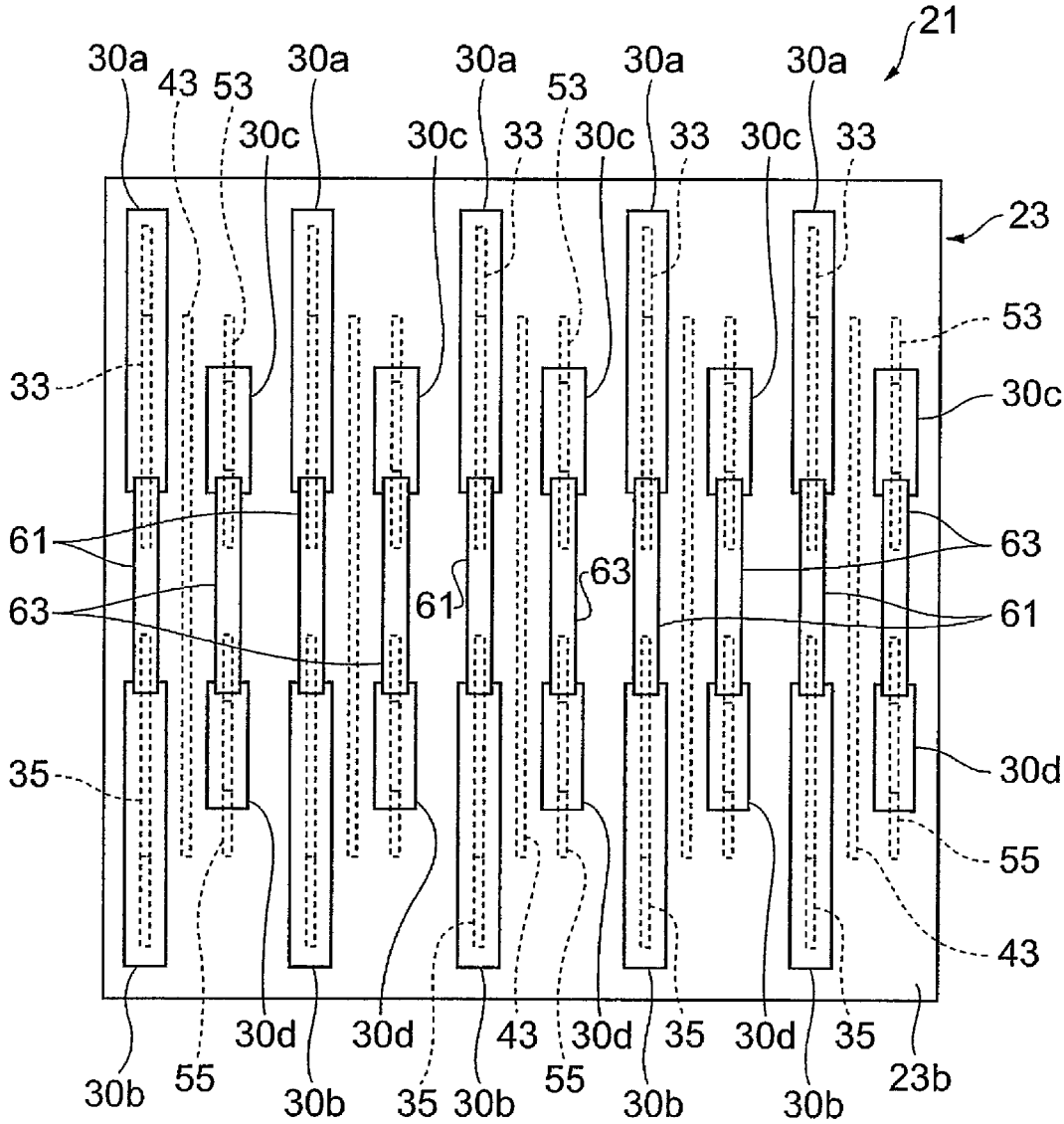
FIG. 4 is a schematic top view of a stacked chip varistor according to a second embodiment.
Figure 5:
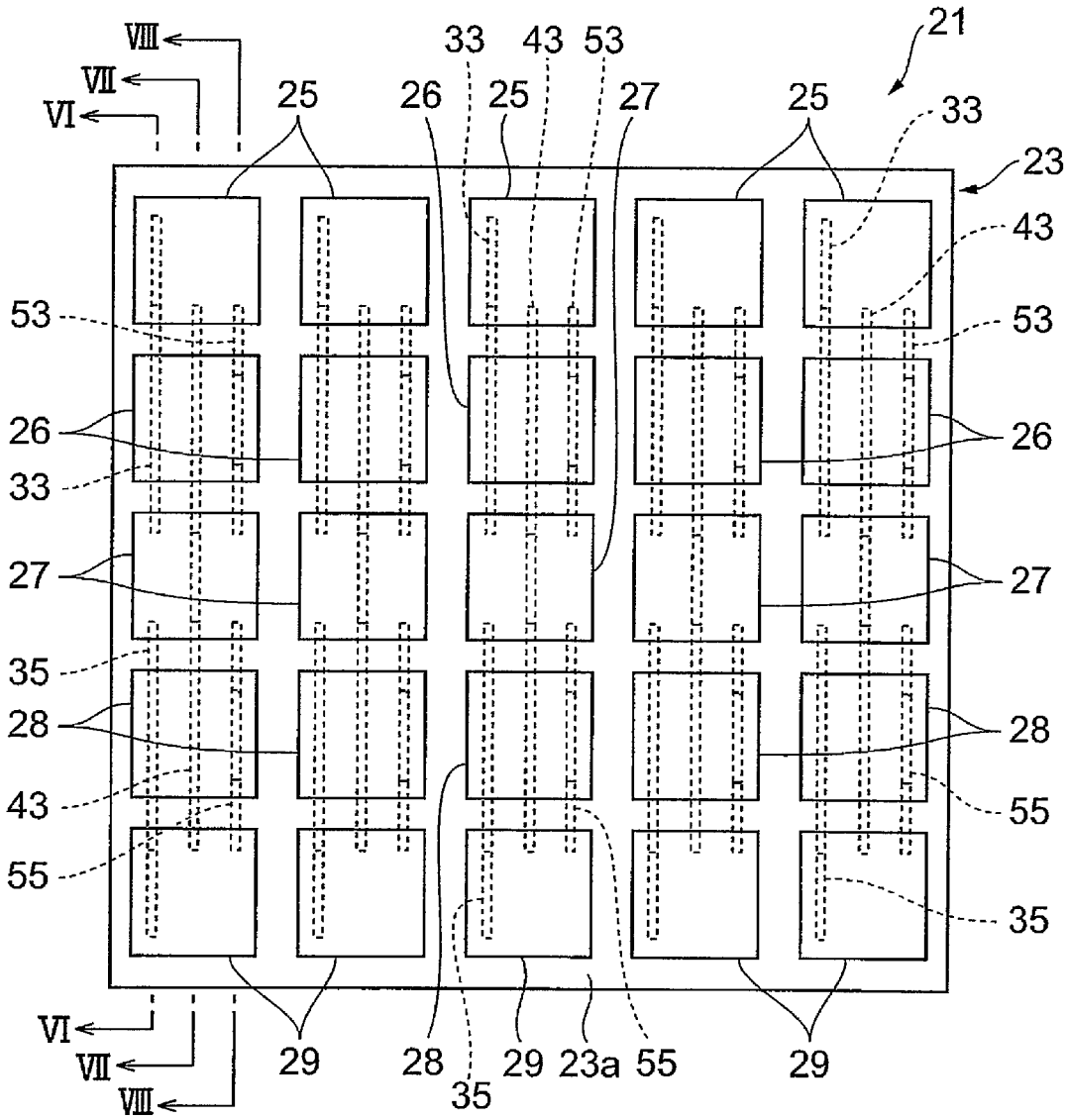
FIG. 5 is a schematic bottom view of a stacked chip varistor according to the second embodiment.
Figure 6:
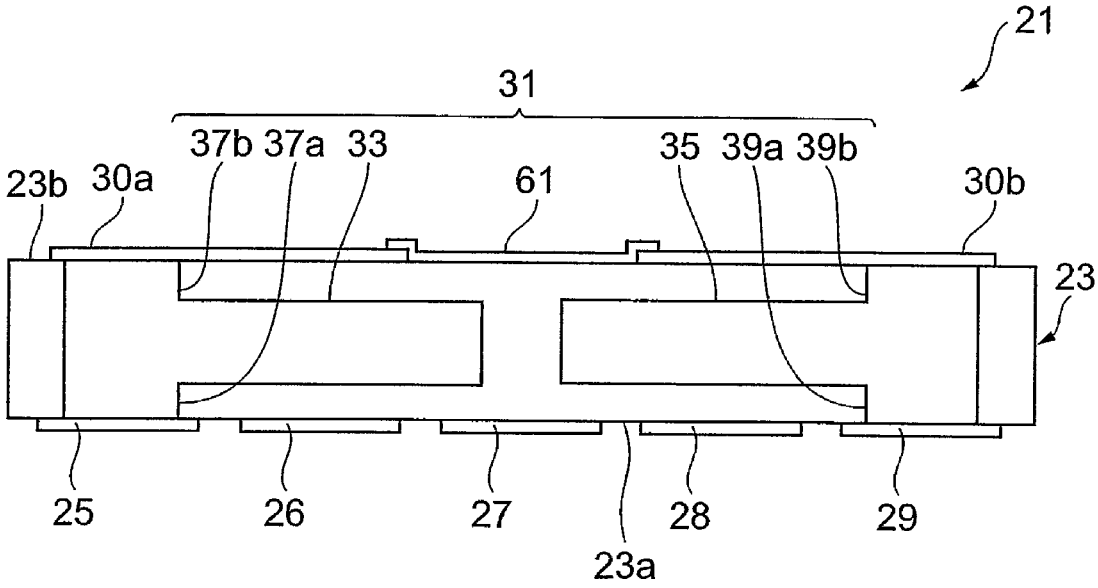
FIG. 6 is a diagram showing the cross-sectional structure along line VI-VI in FIG. 5.
Figure 7:
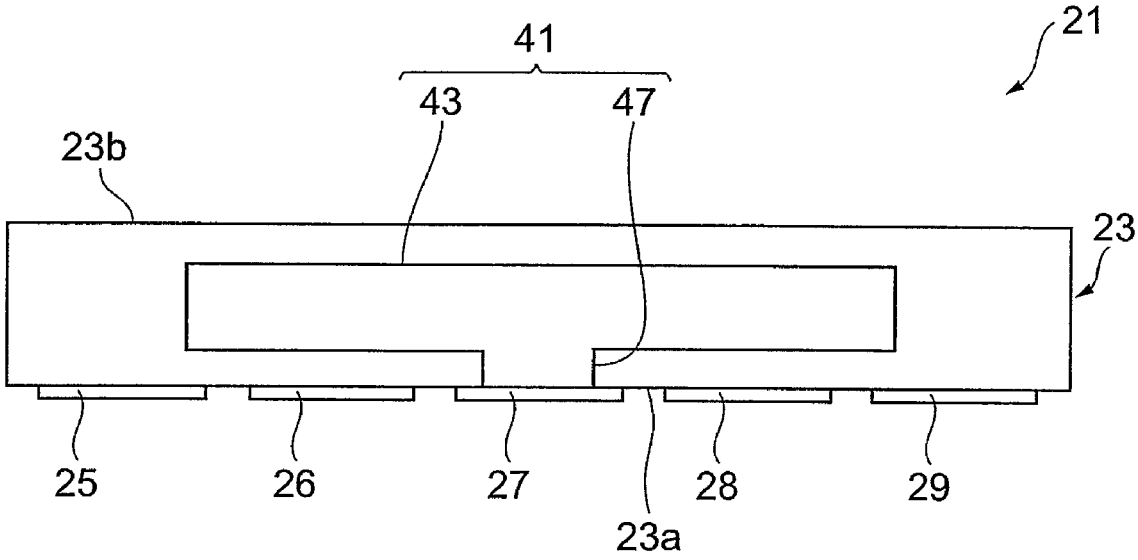
FIG. 7 is a diagram showing the cross-sectional structure along line VII-VII in FIG. 5.
Figure 8:
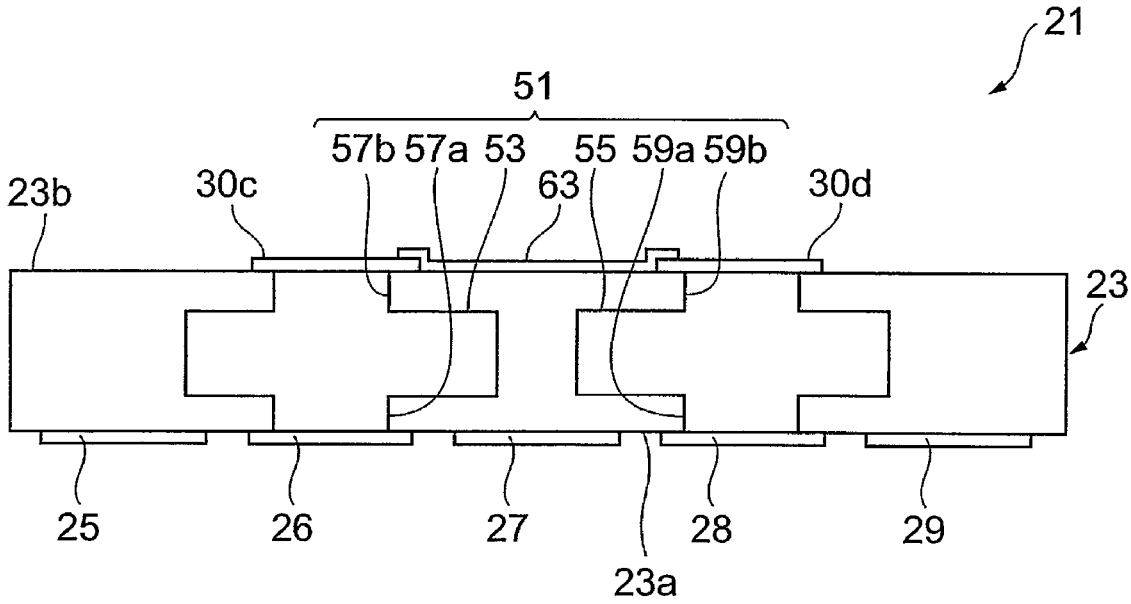
FIG. 8 is a diagram showing the cross-sectional structure along line VIII-VIII in FIG. 5.

FIG. 4 is a schematic top view of a stacked chip varistor according to the second embodiment. FIG. 5 is a schematic bottom view of a stacked chip varistor according to the second embodiment. FIG. 6 is a diagram showing the cross-sectional structure along line VI-VI in FIG. 5. FIG. 7 is a diagram showing the cross-sectional structure along line VII-VII in FIG. 5. FIG. 8 is a diagram showing the cross-sectional structure along line VIII-VIII in FIG. 5.

As shown in FIGS. 4 to 8, the stacked chip varistor 21 comprises a roughly rectangular tabular varistor element 23, a plurality (25 according to this embodiment) external electrodes 25-29 formed on one main side (the lower side) 23*a* of the varistor element 23, and a plurality (20 according to this embodiment) external electrodes 30*a*-30*d* formed on the other main side (the upper side) 23*b* of the varistor element 23. The varistor element 23 may have, for example, a length of about 3 mm, a width of about 3 mm and a thickness of about 0.5 mm. The external electrodes 25, 26, 28, 29 function as input/output terminal electrodes for the stacked chip varistor 21, while the external electrode 27 functions as a ground terminal electrode for the stacked chip varistor 21. The external electrodes 30*a*-30*d* function as external electrodes (pad electrodes) that are electrically connected to the resistors 61, 63 described hereunder.

The varistor element 23 is constructed as a laminated body, obtained by laminating a plurality of varistor layers and a plurality of first to third internal electrode layers 31 (FIG. 6), 41 (FIG. 7), 51 (FIG. 8). Each of the first to third internal electrode layers 31, 41, 51 is a single internal electrode group, and a plurality (5 according to this embodiment) of internal electrode groups are situated along the lamination direction of the varistor layer in the varistor element 23 (hereinafter referred to simply as "lamination direction"). In each internal electrode group, the first to third internal electrode layers 31, 41, 51 are situated in the order: first internal electrode layer 31, second internal electrode layer 41, third internal electrode layer 51, with at least one varistor layer lying between them. The internal electrode groups are also situated with at least one varistor layer lying between them. In an actual stacked chip varistor 21, a plurality of varistor layers are integrated to an extent that the boundaries between them are indistinguishable. Each varistor layer contains the same components as the varistor element of the first embodiment described above.

As shown in FIG. 6, each first internal electrode layer 31 comprises a first internal electrode 33 and a second internal electrode 35. The first and second internal electrodes 33, 35 are roughly rectangular. The first and second internal electrodes 33, 35 are formed at a prescribed spacing from the side of the varistor element 23 parallel to the lamination direction, and at a prescribed mutual spacing to render them electrically insulated from each other.

Each first internal electrode 33 is electrically connected to the external electrode 25 via a lead conductor 37*a*, and electrically connected to the external electrode 30*a* via a lead conductor 37*b*. The lead conductors 37*a*, 37*b* are formed integrally with the first internal electrode 33. Each second internal electrode 35 is electrically connected to the external electrode 29 via a lead conductor 39*a*, and electrically connected to the external electrode 30*b* via a lead conductor 39*b*. The lead conductors 39*a*, 39*b* are formed integrally with the second internal electrode 35.

As shown in FIG. 7 as well, each second internal electrode layer 41 comprises a third internal electrode 43. The third internal electrode 43 is roughly rectangular. The third internal electrode 43 is formed at a prescribed spacing from the side of the varistor element 23 parallel to the lamination direction, and overlapping the first and second internal electrodes 33, 35 as viewed from the lamination direction. Each third internal electrode 43 is electrically connected to an external electrode 27 via a lead conductor 47. The lead conductor 47 is formed integrally with the third internal electrode 43.

As also shown in FIG. 8, each third internal electrode layer 51 comprises a fourth internal electrode 53 and a fifth internal electrode 55. The fourth and fifth internal electrodes 53, 55 are roughly rectangular. The fourth and fifth internal electrodes 53, 55 are formed at a prescribed spacing from the side of the varistor element 23 parallel to the lamination direction, and overlapping the third internal electrode 43 as viewed from the lamination direction, with a prescribed mutual spacing to render them electrically insulated from each other.

Each fourth internal electrode 53 is electrically connected to the external electrode 26 via a lead conductor 57*a*, and electrically connected to the external electrode 30*c* via a lead conductor 57*b*. The lead conductors 57*a*, 57*b* are formed integrally with the fourth internal electrode 53. Each fifth internal electrode 55 is electrically connected to the external electrode 28 via a lead conductor 59*a*, and electrically connected to the external electrode 30*d* via a lead conductor 59*b*. The lead conductors 59*a*, 59*b* are formed integrally with the fifth internal electrode 55.

The first to fifth internal electrodes 33, 35, 43, 53, 55 contain the same components as the external electrode of the first embodiment described above. The internal electrodes contain the same components as the external electrodes of the first embodiment described above. The lead conductors 37*a*, 37*b*, 39*a*, 39*b*, 47, 57*a*, 57*b*, 59*a*, 59*b* also contain the same components as the external electrodes of the first embodiment. The internal electrodes and lead conductors preferably also contain an oxide different from bismuth oxide and copper oxide.

The external electrode 30*a* and external electrode 30*b* are situated on the main side 23*b* of the varistor element, perpendicular to the lamination direction of the varistor layer and at a prescribed spacing in the direction parallel to the main side 23*b* (FIG. 4). The external electrode 30*c* and external electrode 30*d* are situated on the main side 23*b*, perpendicular to the lamination direction of the varistor layer and at a prescribed spacing in the direction parallel to the main side 23*b*. The prescribed spacing between the external electrode 30*a* and external electrode 30*b* and the prescribed spacing between the external electrode 30*c* and external electrode 30*d* are designed to be equivalent. The external electrodes 30*a*-30*d* are rectangular shape (long rectangular according to this embodiment). The external electrodes 30*a*, 30*b* have, for example, long side lengths of about 1000 μm, short side lengths of about 150 μm, and thicknesses of about 2 μm. The external electrodes 30*c*, 30*d* have, for example, long side lengths of about 500 μm, short side lengths of about 150 μm, and thicknesses of about 2 μm.

The external electrodes 30*a*-30*d* contain the same components as the external electrodes of the first embodiment described above. That is, they contain an oxide different from bismuth oxide and copper oxide. The external electrodes 30*a*-30*d* may be formed, for example, by burning conductive paste containing the metal and metal oxide in the external electrode of the first embodiment. The conductive paste used may be a mixture of an ordinary commercially available glass frit, an organic binder and an organic solvent with the metal or oxide powder. There are no particular restrictions on the organic binder, and it may be selected from among various binders such as ethylcellulose or polyvinyl butyral. The organic solvent may be appropriately selected from among various organic solvents such as terpineol, butylcarbitol, acetone or toluene. The mixing ratios in the conductive paste are not particularly restricted, and for example, the organic binder may be used at 1-20 parts by weight and the organic solvent at 1-40 parts by weight with respect to 100 parts by weight as the total weight of the metal and oxide powder. The mixing ratios may be modified as appropriate for adjustment of the flow property of the conductive paste.

A resistor 61 is formed on the main side 23*b* of the varistor element, spanning the external electrode 30*a* and external electrode 30*b*, while a resistor 63 is formed spanning the external electrode 30*c* and external electrode 30*d*. The resistors 61, 63 contain the same components as the resistor 60 of the first embodiment described above. That is, the resistors 61, 63 contain an oxide different from bismuth oxide and copper oxide. The resistors 61, 63 may be formed by firing a resistive paste comprising a mixture of glass such as $Al_2O_3$—$B_2O_3$—$SiO_2$ with the metal and metal oxide in the resistor of the first embodiment.

One end of the resistor 61 is electrically connected to the first internal electrode 33 via the external electrode 30*a* and lead conductor 37*b*. The other end of the resistor 61 is electrically connected to the second internal electrode 35 via the external electrode 30*b* and lead conductor 39*b*. One end of the resistor 63 is electrically connected to the fourth internal electrode 53 via the external electrode 30*c* and lead conductor 57*b*. The other end of the resistor 63 is electrically connected to the fifth internal electrode 55 via the external electrode 30*d* and lead conductor 59*b*.

The external electrodes 25-29 (FIG. 5) are dimensionally arranged in M rows and N columns (where parameters M and N are each integers of 2 or greater) on one main side 23*a*. According to this embodiment, the external electrodes 25-29 are dimensionally arranged in 5 rows and 5 columns. The external electrodes 25-29 are rectangular shape (square according to this embodiment). The external electrodes 25-29 have, for example, side lengths of about 300 μm and thicknesses of about 2 μm.

The external electrodes 25-29 are formed on the outermost surface of the varistor element 23, and have the same composition as the external electrodes of the first embodiment. The external electrodes 25-29 may be formed by firing a conductive paste in the same manner as for the external electrodes 30*a*-30*d* described above.

As mentioned above, the third internal electrode 43 is formed overlapping with the first and second internal electrodes 33,35 as viewed from the lamination direction. Consequently, the region overlapping the first internal electrode 33 and third internal electrode 43 in the varistor layer functions as a region exhibiting varistor characteristics, and the region overlapping the second internal electrode 35 and third internal electrode 43 in the varistor layer also functions as a region exhibiting varistor characteristics.

Also, the third internal electrode 43 is formed overlapping with the fourth and fifth internal electrodes 53, 55 as viewed from the lamination direction. Consequently, the region overlapping the fourth internal electrode 53 and third internal electrode 43 in the varistor layer functions as a region exhibiting varistor characteristics, and the region overlapping the fifth internal electrode 55 and third internal electrode 43 in the varistor layer also functions as a region exhibiting varistor characteristics.

Figure 9:
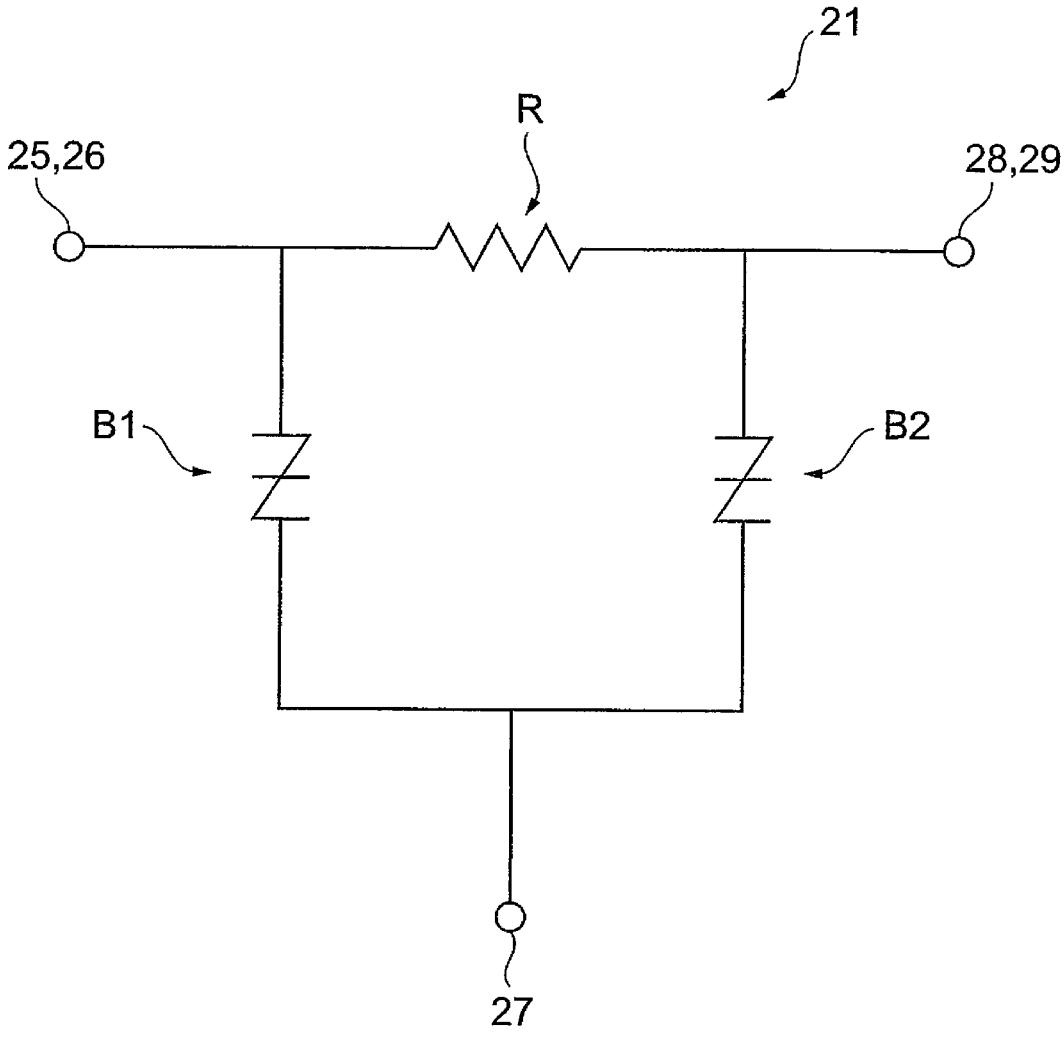
FIG. 9 is a diagram showing an equivalent circuit for a stacked chip varistor according to the second embodiment.

In a stacked chip varistor 21 having such a construction, the resistance R, varistor B1 and varistor B2 are connected in a "π"-shaped fashion, as shown in FIG. 9. The resistance R is composed of a resistor 61 and a resistor 63. The varistor B1 is composed of the first internal electrode 33, the third internal electrode 43 and the region where the first and third internal electrodes 33, 43 overlap in the varistor layer, or by the fourth internal electrode 53, third internal electrode 43 and the region where the fourth and third internal electrodes 53, 43 overlap in the varistor layer. The varistor B2 is composed of the second internal electrode 35, the third internal electrode 43 and the region where the second and third internal electrodes 35, 43 overlap in the varistor layer, or by the fifth internal electrode 55, third internal electrode 43 and the region where the fifth and third internal electrodes 55, 43 overlap in the varistor layer.

Figure 10:
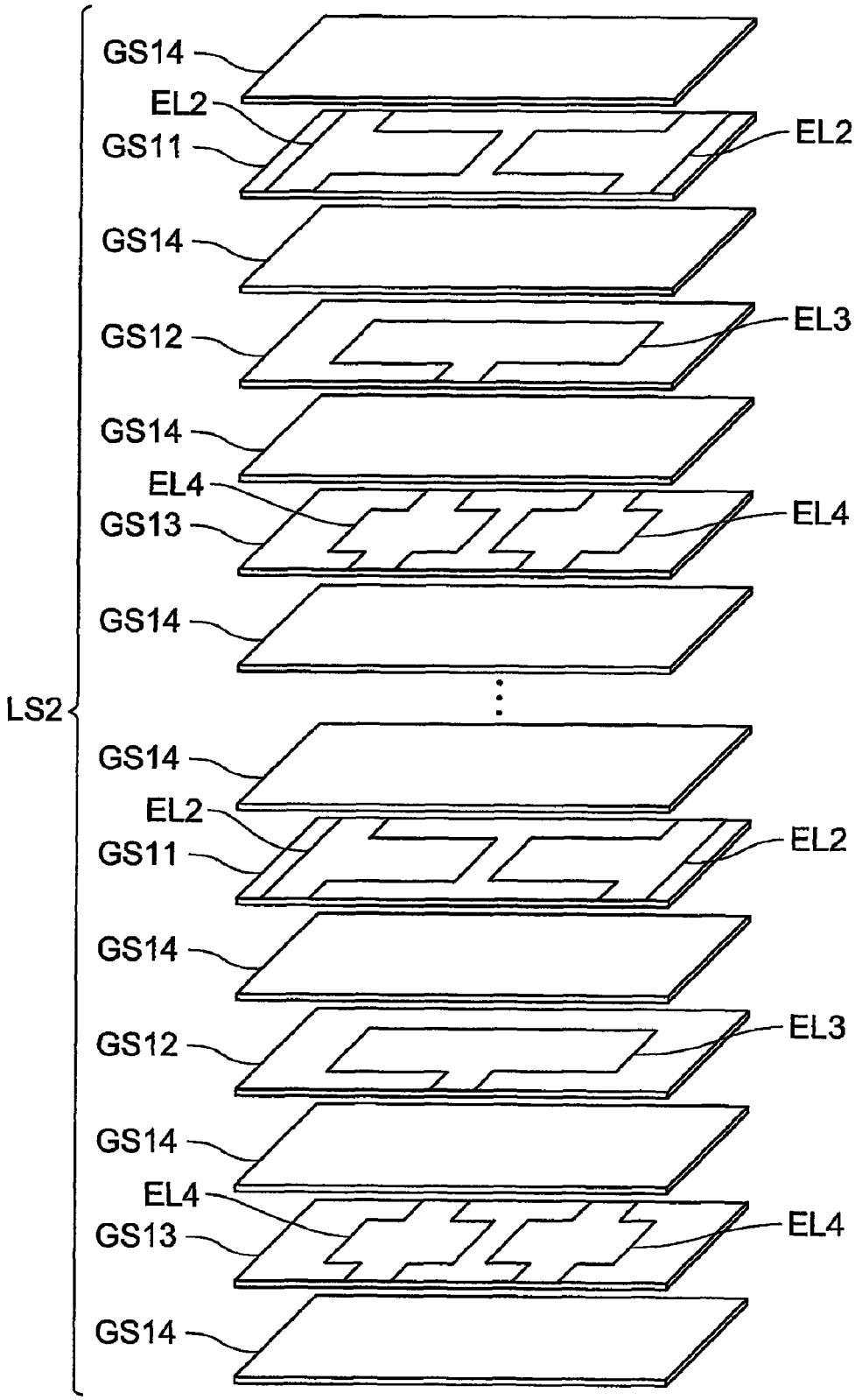
FIG. 10 is a diagram showing the steps of production for a stacked chip varistor according to the second embodiment.

A process for fabrication of a stacked chip varistor 21 according to this second embodiment of the invention will now be explained with reference to FIG. 10. FIG. 10 is a diagram showing the steps of production for a stacked chip varistor according to the second embodiment.

First, amounts of the zinc oxide as the main component of the varistor layer and of the rare earth metal oxide, calcium oxide, silicon oxide and other components are weighed out, and are then combined to prepare a varistor starting material. The paste for formation of the varistor layer may be an organic paste obtained by kneading the varistor starting material with an organic vehicle, or it may be a water-soluble paste. The organic vehicle is obtained by dissolving a binder in an organic solvent. There are no particular restrictions on the binder used for an organic vehicle, and it may be selected from among various ordinary binders such as ethylcellulose or polyvinyl butyral. There are also no particular restrictions on the organic solvent used, and it may be appropriately selected from among terpineol, butylcarbitol, acetone and toluene, depending on the type of method used to form the varistor layer, such as a printing method or sheeting method. The contents of the organic vehicle and varistor starting material in the paste are not particularly restricted. For example, the organic vehicle may be added so that the binder content is about 1-5 wt % and the organic solvent content is about 10-50 wt % with respect to the total paste. If necessary, additives such as dispersing agents, plasticizers, dielectric materials, insulators and the like may also be included in the paste. As water-soluble paste there may be mentioned solutions of water-soluble binders and dispersing agents in water. There are no particular restrictions on the water-soluble binder, and it may be appropriately selected from among polyvinyl alcohol, cellulose, water-soluble acrylic resins and emulsions.

The paste (slurry) used to form the varistor layer may be obtained by mixing and crushing the varistor starting material with materials such as the binder, solvent (organic solvent or water) and various additives, for about 20 hours using a ball mill or the like. The mixing ratio of the starting material for preparation of the slurry may be appropriately adjusted to modify the flow property of the slurry.

The slurry is coated onto a film composed of polyethylene terephthalate, for example, by a known method such as a doctor blade method, and then dried to form a coating with a thickness of about 30 μm. The obtained coating is released from the film to obtain a green sheet.

Several electrode sections (in a number corresponding to the number of partitioned chips) corresponding to the first and second internal electrodes 33, 35 are then formed on the green sheet. Similarly, several electrode sections (in a number corresponding to the number of partitioned chips) corresponding to the third internal electrode 43 are formed on a different green sheet. In addition, several electrode sections (in a number corresponding to the number of partitioned chips) corresponding to the fourth and fifth internal electrodes 53, 55 are then formed on a different green sheet.

The electrode sections corresponding to the first to fifth internal electrodes 33, 35, 43, 53, 55 may be formed, for example, by printing a conductive paste obtained by mixing an oxide different from bismuth oxide and copper oxide, metal powder such as Ag particles or Pd particles, glass frit, an organic binder and an organic solvent, using a printing method such as screen printing, and drying the paste. There are no particular restrictions on the organic binder, and it may be selected from among various binders such as ethylcellulose or polyvinyl butyral. The organic solvent may be appropriately selected from among various organic solvents such as terpineol, butylcarbitol, acetone or toluene. The mixing ratios in the conductive paste are not particularly restricted, and for example, the organic binder may be used at 1-20 parts by weight and the organic solvent at 1-40 parts by weight with respect to 100 parts by weight as the total weight of the metal and oxide powder. The mixing ratios may be modified as appropriate for adjustment of the flow property of the conductive paste.

A laminated sheet is then formed by stacking the green sheets with electrode sections formed thereon and green sheets without electrode sections formed thereon, in a prescribed order. The laminated sheet obtained in this manner is cut into chip units, for example, to obtain multiple partitioned green bodies LS2 (see FIG. 10). The plurality of green bodies LS2 comprises, laminated in order, a green sheet GS11 with the electrode section EL2 formed thereon corresponding to the first and second internal electrodes 33, 35 and the lead conductors 37*a*, 37*b*, 39*a*, 39*b*, a green sheet GS12 having the electrode section EL3 formed thereon corresponding to the third internal electrode 43 and lead conductor 47, a green sheet GS13 having the electrode section EL4 formed thereon corresponding to the fourth and fifth internal electrodes 53, 55 and the lead conductors 57*a*, 57*b*, 59*a*, 59*b*, and a green sheet GS14 without the electrode sections EL2-EL4 formed thereon. If necessary, a plurality of the green sheets GS14 without the electrode sections EL2-EL4 formed thereon may be laminated at each location.

The green body LS2 is then subjected to heat treatment at 180-400° C. for about 0.5-24 hours to remove the binder, and then to firing at 850-1400° C. for about 0.5-8 hours to obtain a varistor element 23. The firing produces varistor layers from the green sheets GS11-GS14 in the plurality of green bodies LS2. The electrode sections EL2 serve as the first and second internal electrodes 33, 35 and the lead conductors 37*a*, 37*b*, 39*a*, 39*b*. The electrode sections EL3 serve as the third internal electrode 43 and lead conductor 47. The electrode sections EL4 serve as the fourth and fifth internal electrodes 53, 55 and the lead conductors 57*a*, 57*b*, 59*a*, 59*b*.

External electrodes 25-29 and external electrodes 30*a*-30*d* are then formed on the outer surface of the varistor element 23. Here, a conductive paste is printed onto one main side 23*a* of the varistor element 23 by a screen printing technique so that it is in contact with the corresponding electrode sections EL2-EL4, and it is dried to form electrode sections corresponding to the external electrodes 25-29. Also, a conductive paste is printed onto the other main side 23*b* of the varistor element 23 by a screen printing technique so that it is in contact with the corresponding electrode sections EL2, EL4, and it is dried to form electrode sections corresponding to the external electrodes 30*a*-30*d*. The electrode sections are then fired at 500-850° C. to obtain a varistor element 23 having external electrodes 25-29 and external electrodes 30*a*-30*d* formed thereon. The conductive paste for the external electrodes 25-29 and external electrodes 30*a*-30*d* may be one obtained by mixing an oxide different from copper oxide and bismuth oxide, metal powder such as Ag particles or Pd particles, glass frit, an organic binder and an organic solvent.

The resistors 61, 63 are then formed in the following manner. First, resistance regions corresponding to the resistors 61, 63 are formed on the main side 23*b* of the varistor element 23, spanning each external electrode 30*a* and external electrode 30*b* pair, and spanning each external electrode 30*c* and external electrode 30*d* pair. Each resistance region corresponding to the resistors 61, 63 is formed by printing resistive paste by a screen printing technique and drying it. The resistive paste is fired at, for example, 800-900° C., to obtain the resistors 61, 63. This procedure yields a stacked chip varistor 21. The external electrodes 25-29 and external electrodes 30*a*-30*d* may also be formed simultaneously with the resistors 61, 63.

The resistive paste is a paste containing an oxide different from bismuth oxide and copper oxide. Specifically, it may be a mixture of an ordinary commercially available organic binder and an organic solvent with glass powder. The glass powder used may be a mixture of glass such as $Al_2O_3$—$B_2O_3$—$SiO_2$ with $RuO_2$. A Sn-based resistive paste may be used, as a mixture of glass such as $Al_2O_3$—$B_2O_3$—$SiO_2$ with $SnO_2$. An La-based resistive paste may also be used, as a mixture of glass such as $Al_2O_3$—$B_2O_3$—$SiO_2$ with $LaB_6$. There are no particular restrictions on the organic binder used to produce the resistive paste, and it may be selected from among various binders such as ethylcellulose or polyvinyl butyral. The organic solvent may be appropriately selected from among various organic solvents such as terpineol, butylcarbitol, acetone or toluene. The mixing ratios in the conductive paste are not particularly restricted, and for example, the organic binder may be used at 1-20 parts by weight and the organic solvent at 1-40 parts by weight with respect to 100 parts by weight as the total weight of the metal and oxide powder. The mixing ratios may be modified as appropriate for adjustment of the flow property of the resistive paste.

After firing, the alkali metals (for example, Li, Na and the like) may be diffused from the surface of the varistor element 23. A protective layer (overglaze layer) may also be formed on the outer surface of the stacked chip varistor 21, except for the regions on which the external electrodes 25-29 have been formed. The protective layer may be formed by printing glaze glass (for example, glass composed of $SiO_2$, ZnO, B, $Al_2O_3$ or the like) and firing it at 500-600° C.

Thus, the varistor of the second embodiment comprises a pair of external electrodes (30*a* and 30*b* or 30*c* and 30*d*) containing an oxide different from bismuth oxide and copper oxide on the main side 23*b* of a varistor element 23 that contains zinc oxide, a rare earth metal oxide, a calcium oxide and a silicon oxide, with a resistor 61 or 63 connecting the pair of external electrodes. The resistors 61, 63 also contain an oxide different from bismuth oxide and copper oxide. This sufficiently inhibits mutual reaction between the external electrodes, resistor and varistor element. This type of stacked chip varistor therefore has low electrostatic capacity while exhibiting excellent varistor characteristics and adequately reducing fluctuations in the resistance value.

Similar to the first embodiment, incidentally, a base glass layer may be formed between the main side 23*b* of the varistor element and the external electrodes 30*a*-30*d*, and/or between the main side 23*b* of the varistor element and the resistors 61, 63. The base glass layer may be formed by printing a paste containing an oxide ordinarily included in glass other than bismuth oxide and copper oxide, such as $SiO_2$—ZnO—BaO—$ZrO_2$—$Al_2O_3$, onto the main side 23*b* of the varistor element 23 by a screen printing technique, and then drying it and firing at 800-900° C., for example. Then, as mentioned above, the external electrodes 30*a*-30*d* and the resistors 61, 63 may be formed on the base glass layer.

The base glass layer-forming paste used to form the base glass layer is prepared by mixing an ordinary commercially available organic binder or organic solvent with the oxide. There are no particular restrictions on the organic binder, and it may be selected from among various binders such as ethylcellulose or polyvinyl butyral. The organic solvent may be appropriately selected from among various organic solvents such as terpineol, butylcarbitol, acetone or toluene. The mixing ratios in the conductive paste are not particularly restricted, and for example, the organic binder may be used at 1-20 parts by weight and the organic solvent at 1-40 parts by weight with respect to 100 parts by weight as the total weight of the metal and oxide powder. The mixing ratios may be modified as appropriate for adjustment of the flow property of the base glass layer-forming paste.

Incidentally, both the external electrodes 25, 26, 28, 29 that function as input/output terminal electrodes and the external electrode 27 that functions as a ground terminal electrode, in the stacked chip varistor 21 of the second embodiment, are situated on one main side 23*a* of the varistor element 23. That is, the stacked chip varistor 21 is a stacked chip varistor in the form of a BGA (Ball Grid Array) package. This stacked chip varistor 21 is mounted on an external board by electrically and mechanically connecting each of the external electrodes 25-29 and the external board lands corresponding to each of the external electrodes 25-29 using solder balls. When the stacked chip varistor 21 has been mounted on the external board, each of the internal electrodes 33, 35, 43, 53, 55 extend in the direction perpendicular to the external board.

The embodiments described above are preferred embodiments of the invention, but the invention is not necessarily limited thereto.

EXAMPLES

The present invention will now be explained in greater detail based on examples and comparative examples, with the understanding that these examples are in no way limitative on the invention.

Example 1

Preparation of Slurry for Varistor Element

First, a starting powder was prepared containing zinc oxide as the main component and the components listed in Table 1 as accessory components. The contents in Table 1 are proportions with respect to zinc oxide. The starting powder, organic binder, organic solvent and additives were mixed and crushed for 20 hours using a ball mill to obtain a slurry for the varistor element.

TABLE 1

| Compound | Proportion (atomic %) |
|---|---|
| $SiO_2$ | 7.11 |
| $K_2O$ | 0.04 |
| CaO | 20.31 |
| $Cr_2O_3$ | 0.05 |
| $Co_3O_4$ | 0.70 |
| $Pr_6O_{11}$ | 0.09 |

The proportions of the compounds in the table are values based on the metal or metalloid atoms.

<Preparation of Conductive Paste for Formation of External Electrodes>

A conductive paste was prepared containing the components for "Electrode A" listed in Table 2. Specifically, each of the components of the "Electrode A" shown in Table 2 were mixed in the proportions shown in Table 2 to prepare a starting mixture.

The starting mixture was mixed with the organic binder and organic solvent for 20 hours using a ball mill to obtain a conductive paste for formation of external electrodes.

<Preparation of Resistive Paste>

A resistive paste was prepared containing the components for "Resistor a" listed in Table 2. Specifically, each of the components of the "Resistor a" shown in Table 2 were mixed in the proportions shown in Table 2 to prepare a starting mixture.

The prepared starting mixture was mixed with the organic binder and organic solvent for 20 hours using a ball mill to obtain a resistive paste for formation of the resistor.

<Fabrication of Stacked Chip Varistor>

The slurry and each paste prepared in the manner described above were used to fabricate a stacked chip varistor corresponding to the second embodiment described above. The procedure for production of the stacked chip varistor will now be explained with reference to FIGS. 4 to 8 and FIG. 10.

First, the varistor element slurry prepared in the manner described above was coated onto a film composed of polyethylene terephthalate by a doctor blade method, and then dried to form a coating with a thickness of 30 μm. The obtained coating was released from the film to obtain a green sheet.

Electrode sections were then formed on the green sheet, corresponding to the first and second internal electrodes 33, 35 (FIG. 5). Similarly, an electrode section was formed on a different green sheet, corresponding to the third internal electrode 43 (FIG. 5). Also, electrode sections were formed on a different green sheet, corresponding to the fourth and fifth internal electrodes 53, 55 (FIG. 5).

The electrode sections corresponding to the first to fifth internal electrodes 33, 35, 43, 53, 55 were formed by printing ordinary conductive paste by a screen printing technique, and then drying it.

A laminated sheet was then formed by stacking the green sheets with electrode sections formed thereon and green sheets without electrode sections formed thereon, in a prescribed order. The laminated sheet obtained in this manner was cut into chip units to obtain multiple partitioned green bodies LS2 (see FIG. 10).

The plurality of green bodies LS2 were then subjected to heat treatment to remove the binder, and then to firing to obtain a varistor element 23.

After then printing a commercially available Ag—Pt paste onto one main side 23*a* of the varistor element 23 by a screen printing technique and drying it, it was fired at 900-1100° C. to form electrode sections (Ag—Pt conductors) corresponding to external electrodes 25-29.

Then, after printing conductive paste prepared in the same manner onto the main side 23*b* of the varistor element 23 by a screen printing technique, it was dried to form electrode sections corresponding to external electrodes 30*a*-30*d*. These electrode sections were then fired at 850° C. to obtain a varistor element having external electrodes 30*a*-30*d* formed on the main side 23*b*.

A resistive paste prepared in the same manner as described above was then printed by a screen printing technique in such a fashion as to span each pair of external electrodes 30*a* and external electrode 30*b*, and each pair of external electrodes 30*c* and external electrode 30*d*. The resistive paste was dried and fired at 850° C. to form resistors 61, 63. This connected the external electrode 30*a* and external electrode 30*b* by the resistor 61, and connected the external electrode 30*c* and external electrode 30*d* by the resistor 63. The process described above produced a stacked chip varistor 21 as shown in FIG. 4 and FIG. 5.

<Evaluation of Reactivity>

A cross-section of the fabricated stacked chip varistor was subjected to Electron probe microanalyzer analysis (EPMA) to determine whether reaction products were present in the varistor element. Based on the EPMA analysis, reactivity level A was judged when no reaction products were detected that could adversely affect the varistor characteristics (no elements absent in the starting material were detected), and reactivity level B was judged when reaction products were detected (elements absent in the starting material were detected). The results are shown in Table 2.

<Evaluation of Resistance Value>

The resistance value of the fabricated stacked chip varistor was measured. Specifically, the resistance value was measured between the external terminal electrode 25 (26) and the external terminal electrode 29 (28) in the equivalent circuit shown in FIG. 9. Measurement was made at 10 locations between the different external terminal electrodes, and the mean value and standard deviation (σ) were calculated. The value of 3σ/mean value was calculated from this value to evaluate the resistance value fluctuation. The results are shown in Table 2.

Examples 2-5, Comparative Examples 1 and 2

Stacked chip varistors were fabricated and evaluated in the same manner as Example 1, except that for the materials in the resistor-forming resistive paste, the "Resistor a" components shown in Table 2 were changed to the "Resistor b-g" components. The evaluation results are shown in Table 2. The composition of the conductive paste used to form the electrodes was the same as in Example 1.

TABLE 2

| | Example 1 | | Example 2 | Example 3 | Example 4 | Example 5 | Comp. Example 1 | Comp. Example 2 |
|---|---|---|---|---|---|---|---|---|
| Compound | Electrode A wt % | Resistor a wt % | Resistor b wt % | Resistor c wt % | Resistor d wt % | Resistor e wt % | Resistor f wt % | Resistor g wt % |
| $B_2O_3$ | 1.1 | 4.7 | 4.6 | 4.7 | 9.9 | 9.6 | 2.4 | 3.7 |
| $Na_2O$ | | | | | | | | |
| MgO | | | | | 1.3 | | | |
| $Al_2O_3$ | | 0.1 | 1.6 | 0.1 | 2.5 | 3.3 | 1.3 | 2.0 |
| $SiO_2$ | 0.6 | 20.0 | 9.1 | 20.0 | 15.7 | 17.6 | 9.7 | 15.3 |
| $P_2O_5$ | | | | | | | | |
| $SO_3$ | | | | | | | | |
| Cl | | | | | | 0.1 | | |
| $K_2O$ | | 1.3 | 0.5 | 1.3 | 1.6 | 0.8 | 0.2 | 0.5 |
| CaO | | | | | 4.9 | | 0.7 | 1.2 |
| $TiO_2$ | | | | | | | | |
| $V_2O_5$ | | | | | | | | |
| $Cr_2O_3$ | | | | | | | | |
| MnO | 0.5 | 2.8 | 1.2 | 2.8 | 2.4 | 0.6 | 0.6 | 0.6 |
| $Fe_2O_3$ | | 0.2 | | 0.2 | 0.1 | 0.1 | | |
| CoO | | | | | | | | |
| NiO | | | | | | | | |
| CuO | | | | | | | 0.2 | 0.3 |
| ZnO | 2.8 | 2.4 | 4.6 | 2.4 | 8.1 | 10.1 | 0.3 | 0.6 |
| $SrO_2$ | | | | | | 0.1 | | |
| $Y_2O_3$ | | | | | | | | |
| $ZrO_2$ | | 0.2 | | 0.2 | 2.8 | | | |
| $Nb_2O_5$ | | | 0.4 | | | 0.7 | 1.1 | 1.6 |
| $RuO_2$ | | 66.5 | 26.4 | 66.5 | 47.9 | 45.0 | 23.7 | 31.1 |
| Pd | | | 10.4 | | | | 13.4 | 4.6 |
| Ag | 95.0 | 1.8 | 35.5 | 1.8 | 2.7 | | 30.4 | 10.8 |
| $SnO_2$ | | | | | | 0.2 | | |
| BaO | | | 5.7 | | | 11.9 | | |
| PbO | | | | | | | 15.6 | 27.0 |
| $Bi_2O_3$ | | | | | | | | |
| $Sb_2O_3$ | | | | | | | 0.3 | 0.6 |
| Reactivity | A | | A | A | A | A | B | B |
| 3σ/mean [%](*1) | 10 | | 14 | 16 | 27 | 29 | 30 | 16 |

(*1)The symbol "σ" represents the standard deviation for the measured resistance values, and "mean" represents the average value for the measured resistance values.

(*2)The empty cells in the table indicate that those compounds are not present.

Comparative Example 3

A stacked chip varistor was fabricated and evaluated in the same manner as Example 1, except that for the materials in the external electrode-forming conductive paste, the "Electrode A" components shown in Table 2 were changed to the "Electrode B" components shown in Table 3. The evaluation results are shown in Table 3.

Comparative Examples 4-11

Stacked chip varistors were fabricated and evaluated in the same manner as Comparative Example 3, except that for the materials in the resistor-forming resistive paste, the "Resistor a" components shown in Table 3 were changed to the "Resistor b-i" components. The evaluation results are shown in Table 3. The composition of the conductive paste used to form the electrodes was the same as in Comparative Example 3.

Comparative Example 12

A stacked chip varistor was fabricated and evaluated in the same manner as Example 2, except that for the materials in the external electrode-forming conductive paste, the "Electrode A" components shown in Table 2 were changed to the "Electrode C" components shown in Table 4. The evaluation results are shown in Table 4.

Comparative Examples 13-18

Stacked chip varistors were fabricated and evaluated in the same manner as Comparative Example 12, except that for the materials in the resistor-forming resistive paste, the "Resistor b" components shown in Table 4 were changed to the "Resistor c-e" and "Resistor g-i" components. The evaluation results are shown in Table 4. The composition of the conductive paste used to form the external electrodes was the same as in Comparative Example 12.

TABLE 3

| | Comp. Example 3 | | Comp. Example 4 | Comp. Example 5 | Comp. Example 6 | Comp. Example 7 | Comp. Example 8 | Comp. Example 9 | Comp. Example 10 | Comp. Example 11 |
|---|---|---|---|---|---|---|---|---|---|---|
| Compound | Electrode B wt % | Resistor a wt % | Resistor b wt % | Resistor c wt % | Resistor d wt % | Resistor e wt % | Resistor f wt % | Resistor g wt % | Resistor h wt % | Resistor i wt % |
| $B_2O_3$ | 1.1 | 4.7 | 4.6 | 4.7 | 9.9 | 9.6 | 2.4 | 3.7 | 17.5 | 4.6 |
| $Na_2O$ | | | | | | | | | 0.2 | |
| MgO | | | | | 1.3 | | | | | |
| $Al_2O_3$ | 0.7 | 0.1 | 1.6 | 0.1 | 2.5 | 3.3 | 1.3 | 2.0 | 2.7 | 2.2 |
| $SiO_2$ | 0.3 | 20.0 | 9.1 | 20.0 | 15.7 | 17.6 | 9.7 | 15.3 | 12.5 | 17.9 |
| $P_2O_5$ | | | | | | | | | | |
| $SO_3$ | 0.1 | | | | | | | | | |
| Cl | | | | | | 0.1 | | | | 0.1 |
| $K_2O$ | | 1.3 | 0.5 | 1.3 | 1.6 | 0.8 | 0.2 | 0.5 | 0.1 | 0.5 |
| CaO | | | | | 4.9 | | 0.7 | 1.2 | 1.2 | 1.5 |
| $TiO_2$ | | | | | | | | | 0.2 | |
| $V_2O_5$ | | | | | | | | | | |
| $Cr_2O_3$ | | | | | | | | | | |
| MnO | | 2.8 | 1.2 | 2.8 | 2.4 | 0.6 | 0.6 | 0.6 | 2.9 | 0.1 |
| $Fe_2O_3$ | | 0.2 | | 0.2 | 0.1 | 0.1 | | | 0.05 | |
| CoO | | | | | | | | | | |
| NiO | | | | | | | | | | |
| CuO | 4.7 | | | | | | 0.2 | 0.3 | | 0.4 |
| ZnO | 3.0 | 2.4 | 4.6 | 2.4 | 8.1 | 10.1 | 0.3 | 0.6 | | 0.8 |
| $SrO_2$ | | | | | | 0.1 | | | | |
| $Y_2O_3$ | | | | | | | | | | |
| $ZrO_2$ | | 0.2 | | 0.2 | 2.8 | | | | | |
| $Nb_2O_5$ | | | 0.4 | | | 0.7 | 1.1 | 1.6 | | 2.2 |
| $RuO_2$ | | 66.5 | 26.4 | 66.5 | 47.9 | 45.0 | 23.7 | 31.1 | 32.2 | 36.9 |
| Pd | 27.7 | | 10.4 | | | | 13.4 | 4.6 | 4.6 | |
| Ag | 62.1 | 1.8 | 35.5 | 1.8 | 2.7 | | 30.4 | 10.8 | 8.8 | |
| $SnO_2$ | | | | | | 0.2 | | | | |
| BaO | 0.3 | | 5.7 | | | 11.9 | | | | |
| PbO | | | | | | | 15.6 | 27.0 | 16.7 | 31.8 |
| $Bi_2O_3$ | | | | | | | | | 0.5 | |
| $Sb_2O_3$ | | | | | | | 0.3 | 0.6 | | 1.0 |
| Reactivity | B | | B | B | B | B | B | B | B | B |
| 3σ/mean [%](*1) | 58 | | 41 | 27 | 37 | 32 | 24 | 98 | 36 | 62 |

(*1) The symbol "σ" represents the standard deviation for the measured resistance values, and "mean" represents the average value for the measured resistance values.
(*2) The empty cells in the table indicate that those compounds are not present.

TABLE 4

| Compound | Comp. Example 12 Electrode C wt % | Comp. Example 12 Resistor b wt % | Comp. Example 13 Resistor c wt % | Comp. Example 14 Resistor d wt % | Comp. Example 15 Resistor e wt % | Comp. Example 16 Resistor g wt % | Comp. Example 17 Resistor h wt % | Comp. Example 18 Resistor i wt % |
|---|---|---|---|---|---|---|---|---|
| $B_2O_3$ | 0.2 | 4.6 | 4.7 | 9.9 | 9.6 | 3.7 | 17.5 | 4.6 |
| $Na_2O$ | | | | | | | 0.2 | |
| MgO | | | | 1.3 | | | | |
| $A_{12}O_3$ | 3.3 | 1.6 | 0.1 | 2.5 | 3.3 | 2.0 | 2.7 | 2.2 |
| $SiO_2$ | 3.1 | 9.1 | 20.0 | 15.7 | 17.6 | 15.3 | 12.5 | 17.9 |
| $P_2O_5$ | | | | | | | | |
| $SO_3$ | | | | | | | | |
| Cl | | | | | 0.1 | | | 0.1 |
| $K_2O$ | | 0.5 | 1.3 | 1.6 | 0.8 | 0.5 | 0.1 | 0.5 |
| CaO | 0.2 | | | 4.9 | | 1.2 | 1.2 | 1.5 |
| $TiO_2$ | | | | | | | 0.2 | |
| $V_2O_5$ | | | | | | | | |
| $Cr_2O_3$ | | | | | | | | |
| MnO | | 1.2 | 2.8 | 2.4 | 0.6 | 0.6 | 2.9 | 0.1 |
| $Fe_2O_3$ | | | 0.2 | 0.1 | 0.1 | | 0.05 | |
| CoO | | | | | | | | |
| NiO | | | | | | | | |
| CuO | | | | | | 0.3 | | 0.4 |
| ZnO | | 4.6 | 2.4 | 8.1 | 10.1 | 0.6 | | 0.8 |
| $SrO_2$ | | | | | 0.1 | | | |
| $Y_2O_3$ | | | | | | | | |
| $ZrO_2$ | | | 0.2 | 2.8 | | | | |
| $Nb_2O_5$ | | 0.4 | | | 0.7 | 1.6 | | 2.2 |
| $RuO_2$ | | 26.4 | 66.5 | 47.9 | 45.0 | 31.1 | 32.2 | 36.9 |
| Pd | 24.3 | 10.4 | | | | 4.6 | 4.6 | |
| Ag | 62.7 | 35.5 | 1.8 | 2.7 | | 10.8 | 8.8 | |
| $SnO_2$ | | | | | 0.2 | | | |
| BaO | | 5.7 | | | 11.9 | | | |
| PbO | | | | | | 27.0 | 16.7 | 31.8 |
| $Bi_2O_3$ | 6.2 | | | | | | 0.5 | |
| $Sb_2O_3$ | | | | | | 0.6 | | 1.0 |
| Reactivity | B | | B | B | B | B | B | B |
| 3σ/mean [%1(*1) | 25 | | 17 | 78 | 13 | 76 | 46 | 27 |

(*1)The symbol "σ" represents the standard deviation for the measured resistance values, and "mean" represents the average value for the measured resistance values.
(*2)The empty cells in the table indicate that those compounds are not present.

Comparative Example 19

A stacked chip varistor was fabricated and evaluated in the same manner as Example 2, except that for the materials in the external electrode-forming conductive paste, the "Electrode A" components shown in Table 2 were changed to the "Electrode D" components shown in Table 5. The evaluation results are shown in Table 5.

Comparative Examples 20-25

Stacked chip varistors were fabricated and evaluated in the same manner as Comparative Example 19, except that for the materials in the resistor-forming resistive paste, the "Resistor b" components shown in Table 5 were changed to the "Resistor c-e" and "Resistor g-r" components. The evaluation results are shown in Table 5. The composition of the conductive paste used to form the external electrodes was the same as in Comparative Example 19.

TABLE 5

| Compound | Comp. Example 19 Electrode D wt % | Comp. Example 19 Resistor b wt % | Comp. Example 20 Resistor c wt % | Comp. Example 21 Resistor d wt % | Comp. Example 22 Resistor e wt % | Comp. Example 23 Resistor g wt % | Comp. Example 24 Resistor h wt % | Comp. Example 25 Resistor i wt % |
|---|---|---|---|---|---|---|---|---|
| $B_2O_3$ | 0.5 | 4.6 | 4.7 | 9.9 | 9.6 | 3.7 | 17.5 | 4.6 |
| $Na_2O$ | 0.1 | | | | | | 0.2 | |
| MgO | 0.1 | | | 1.3 | | | | |
| $A_{12}O_3$ | 1.1 | 1.6 | 0.1 | 2.5 | 3.3 | 2.0 | 2.7 | 2.2 |

TABLE 5-continued

| Compound | Comp. Example 19 Electrode D wt % | Comp. Example 19 Resistor b wt % | Comp. Example 20 Resistor c wt % | Comp. Example 21 Resistor d wt % | Comp. Example 22 Resistor e wt % | Comp. Example 23 Resistor g wt % | Comp. Example 24 Resistor h wt % | Comp. Example 25 Resistor i wt % |
|---|---|---|---|---|---|---|---|---|
| $SiO_2$ | 3.5 | 9.1 | 20.0 | 15.7 | 17.6 | 15.3 | 12.5 | 17.9 |
| $P_2O_5$ | | | | | | | | |
| $SO_3$ | | | | | | | | |
| Cl | | | | | 0.1 | | | 0.1 |
| $K_2O$ | | 0.5 | 1.3 | 1.6 | 0.8 | 0.5 | 0.1 | 0.5 |
| CaO | 1.6 | | | 4.9 | | 1.2 | 1.2 | 1.5 |
| $TiO_2$ | | | | | | | 0.2 | |
| $V_2O_5$ | | | | | | | | |
| $Cr_2O_3$ | | | | | | | | |
| MnO | | 1.2 | 2.8 | 2.4 | 0.6 | 0.6 | 2.9 | 0.1 |
| $Fe_2O_3$ | | | 0.2 | 0.1 | 0.1 | | 0.05 | |
| CoO | | | | | | | | |
| NiO | | | | | | | | |
| CuO | | | | | | 0.3 | | 0.4 |
| ZnO | | 4.6 | 2.4 | 8.1 | 10.1 | 0.6 | | 0.8 |
| $SrO_2$ | | | | | 0.1 | | | |
| $Y_2O_3$ | | | | | | | | |
| $ZrO_2$ | | | 0.2 | 2.8 | | | | |
| $Nb_2O_5$ | | 0.4 | | | 0.7 | 1.6 | | 2.2 |
| $RuO_2$ | | 26.4 | 66.5 | 47.9 | 45.0 | 31.1 | 32.2 | 36.9 |
| Pd | 24.3 | 10.4 | | | | 4.6 | 4.6 | |
| Ag | 55.8 | 35.5 | 1.8 | 2.7 | | 10.8 | 8.8 | |
| $SnO_2$ | | | | | 0.2 | | | |
| BaO | | 5.7 | | | 11.9 | | | |
| PbO | | | | | | 27.0 | 16.7 | 31.8 |
| $Bi_2O_3$ | 12.9 | | | | | | 0.5 | |
| $Sb_2O_3$ | | | | | | 0.6 | | 1.0 |
| Reactivity | B | | B | B | B | B | B | B |
| 3σ/mean [%](*1) | 16 | | 156 | 709 | 147 | 283 | 27 | 445 |

(*1)The symbol "σ" represents the standard deviation for the measured resistance values, and "mean" represents the average value for the measured resistance values.
(*2)The empty cells in the table indicate that those compounds are not present.

Comparative Example 26

A conductive paste was prepared containing the components for "Electrode A" listed in Table 6, in the same manner as Example 1. A resistive paste was also prepared containing the components for resistor h listed in Table 6.

<Preparation of Paste for Base Layer Glass>

A paste was prepared containing the components for "Base layer glass 1" listed in Table 6. Specifically, each of the components of the "Base layer glass 1" shown in Table 6 were mixed in the proportions shown in Table 6 to prepare a starting mixture. The prepared starting mixture was mixed with the organic binder and organic solvent for 20 hours using a ball mill to obtain a paste for formation of the base layer glass.

<Fabrication of Stacked Chip Varistor>

Each paste prepared in the manner described above was used to fabricate a varistor element 23 in the same manner as Example 1. After printing the base layer glass-forming paste prepared as described above onto the main side 23*b* of the varistor element 23 by a screen printing technique, it was dried and fired at 850° C. to form a base glass layer.

Then, after printing external electrode-forming conductive paste prepared as described above onto the formed base glass layer by a screen printing technique, it was dried to form electrode sections corresponding to external electrodes 30*a*-30*d*. These electrode sections were then fired at 850° C. to obtain a varistor element having external electrodes 30*a*-30*d* formed on the base glass layer (not shown).

A resistive paste prepared in the same manner described above was then printed by a screen printing technique in such a fashion as to span each pair of external electrodes 30*a* and external electrode 30*b*, and each pair of external electrodes 30*c* and external electrode 30*d*. The resistive paste was dried and fired at 850° C. to form resistors 61, 63. The process described above produced a stacked chip varistor 21 as shown in FIG. 4 and FIG. 5.

The reactivity was evaluated in the same manner as Example 1. The results are shown in Table 6.

Comparative Examples 27-31

Stacked chip varistors were fabricated and evaluated in the same manner as Comparative Example 26, except that for the materials in the base layer glass-forming paste, the "Base layer glass 1" components shown in Table 6 were changed to the "Base layer glass 2-6" components. The evaluation results are shown in Table 6. The compositions of the pastes used to form the electrodes and resistor were the same as in Comparative Example 26.

TABLE 6

| Compound | Comp. Example 26 Electrode A wt % | Comp. Example 26 Resistor h wt % | Comp. Example 26 Base layer glass 1 wt % | Comp. Example 27 Base layer glass 2 wt % | Comp. Example 28 Base layer glass 3 wt % | Comp. Example 29 Base layer glass 4 wt % | Comp. Example 30 Base layer glass 5 wt % | Comp. Example 31 Base layer glass 6 wt % |
|---|---|---|---|---|---|---|---|---|
| $B_2O_3$ | 1.1 | 17.5 | | 23.0 | 23.0 | 5.0 | 27.0 | 8.0 |
| $Na_2O$ | | 0.2 | | 6.0 | | | | |
| MgO | | | | | | | | 0.04 |
| $Al_2O_3$ | | 2.7 | 29.4 | 3.0 | | 4.0 | | 2.0 |
| $SiO_2$ | 0.6 | 12.5 | 28.5 | 53.0 | 12.0 | 7.0 | 28.0 | 10.0 |
| $P_2O_5$ | | | | | | | | 0.01 |
| $SO_3$ | | | | | | | | |
| Cl | | | | | | | | |
| $K_2O$ | | 0.1 | | 6.0 | | | | |
| CaO | | 1.2 | 0.8 | | | | 30.0 | |
| $TiO_2$ | | 0.2 | | | | | | |
| $V_2O_5$ | | | | | | | 7.0 | |
| $Cr_2O_3$ | | | | | | | | |
| MnO | 0.5 | 2.9 | | | | | | |
| $Fe_2O_3$ | | 0.05 | | | 10.0 | | | |
| CoO | | | 0.4 | | | | | |
| NiO | | | | | | | | |
| CuO | | | | | | | | |
| ZnO | 2.8 | | 12.2 | | 55.0 | 11.0 | | 13.0 |
| $SrO_2$ | | | 0.3 | | | | | |
| $Y_2O_3$ | | | | | | | | |
| $ZrO_2$ | | | 3.1 | | | | 8.0 | |
| $Nb_2O_5$ | | | | | | | | |
| $RuO_2$ | | 32.2 | | | | | | |
| Pd | | 4.6 | | | | | | |
| Ag | 95.0 | 8.8 | | | | | | |
| $SnO_2$ | | | 0.3 | | | | | |
| BaO | | | 25.0 | 9.0 | | | | 1.0 |
| PbO | | 16.7 | | | | | | |
| $Bi_2O_3$ | | 0.5 | | | | 73.0 | | 66.0 |
| $Sb_2O_3$ | | | | | | | | |
| Reactivity | | A | | B | B | B | B | B |

(*1)The empty cells in the table indicate that those compounds are not present.

The stacked chip varistors comprising the resistors 61, 63 and the external electrodes 30*a*-30*d* containing no bismuth oxide and copper oxide had no reaction products in the varistor element, and the resistance fluctuation was also minimal.

What is claimed is:

1. A varistor comprising a varistor element, a pair of external electrodes on one main side of the varistor element and a resistor on the same main side, the resistor being formed in connection with the pair of external electrodes, wherein the varistor element has a main component and accessory components, containing zinc oxide as the main component and calcium oxides, silicon oxides and rare earth metal oxides as the accessory components, the proportion X of the calcium oxides in terms of calcium atoms is 2-80 atomic percent with respect to 100 mol of the main component and the proportion Y of the silicon oxides in terms of silicon atoms is 1-40 atomic percent with respect to 100 mol of the main component, the ratio of X to Y (X/Y) satisfying the following formula (1):

$$1 \leq X/Y < 3 \quad (1)$$

and the external electrode and the resistor contain oxides other than bismuth oxide and copper oxide.

2. A varistor according to claim 1, which is provided with a base glass layer between the main side of the varistor element and either or both the pair of external electrodes and the resistor.

3. A varistor according to claim 1, wherein the resistor is provided so as to cover at least part of the sides of the external electrodes opposite their varistor element sides.

4. A varistor according to claim 1, which is provided with a glass layer covering the resistor and the pair of external electrodes.

5. A varistor according to claim 2, which is provided with a glass layer covering the resistor and the pair of external electrodes.

6. A varistor according to claim 3, which is provided with a glass layer covering the resistor and the pair of external electrodes.

* * * * *